US012734572B2

(12) United States Patent
Del Fabro

(10) Patent No.: US 12,734,572 B2
(45) Date of Patent: Sep. 15, 2026

(54) APPARATUS AND METHOD FOR BENDING ELONGATED METAL PRODUCTS

(71) Applicant: M.E.P. MACCHINE ELETTRONICHE PIEGATRICI S.P.A., Reana del Rojale (IT)

(72) Inventor: Giorgio Del Fabro, Udine (IT)

(73) Assignee: M.E.P. MACCHINE ELETTRONICHE PIEGATRICI S.P.A., Reana del Rojale (IT)

( * ) Notice: Subject to any disclaimer, the term of this patent is extended or adjusted under 35 U.S.C. 154(b) by 217 days.

(21) Appl. No.: 18/836,836

(22) PCT Filed: Feb. 7, 2023

(86) PCT No.: PCT/IT2023/050031
§ 371 (c)(1),
(2) Date: Aug. 8, 2024

(87) PCT Pub. No.: WO2023/152776
PCT Pub. Date: Aug. 17, 2023

(65) Prior Publication Data

US 2025/0153233 A1 May 15, 2025

(30) Foreign Application Priority Data

Feb. 10, 2022 (IT) ..... 102022000002417

(51) Int. Cl.
*B21D 7/024* (2006.01)
*B21D 7/12* (2006.01)
(Continued)

(52) U.S. Cl.
CPC ..... *B21D 7/024* (2013.01); *B21D 7/12* (2013.01); *B21D 11/12* (2013.01); *B21D 11/22* (2013.01);
(Continued)

(58) Field of Classification Search
CPC ..... B21D 7/024; B21D 7/12; B21D 11/12; B21D 11/22; B21D 37/14; B21D 37/147; B21F 1/00
See application file for complete search history.

(56) References Cited

U.S. PATENT DOCUMENTS 3,580,023 A * 5/1971 Merrill ..... B21D 7/12 72/461
3,680,347 A * 8/1972 Schenck ..... B21D 7/024 72/217
(Continued)

FOREIGN PATENT DOCUMENTS

IT UD20070240 A1 6/2009
JP H05285755 A 11/1993
(Continued)

OTHER PUBLICATIONS

International Search Report and Written Opinion for International PCT Application No. PCT/IT2023/050031, dated May 12, 2023.

*Primary Examiner* — Ryan J. Walters
(74) *Attorney, Agent, or Firm* — K&L Gates LLP

(57) ABSTRACT

Apparatus (10) for bending elongated metal products (100) comprising a feed device (13), which moves the products (100) along a feed axis (X) and a first bending unit (15) provided with one or more pins (20, 22), the latter distinct from each other and configured to bend one or more products (100) at a time at in correspondence with a determinate bending zone (BZ).

9 Claims, 6 Drawing Sheets

Figure 1:
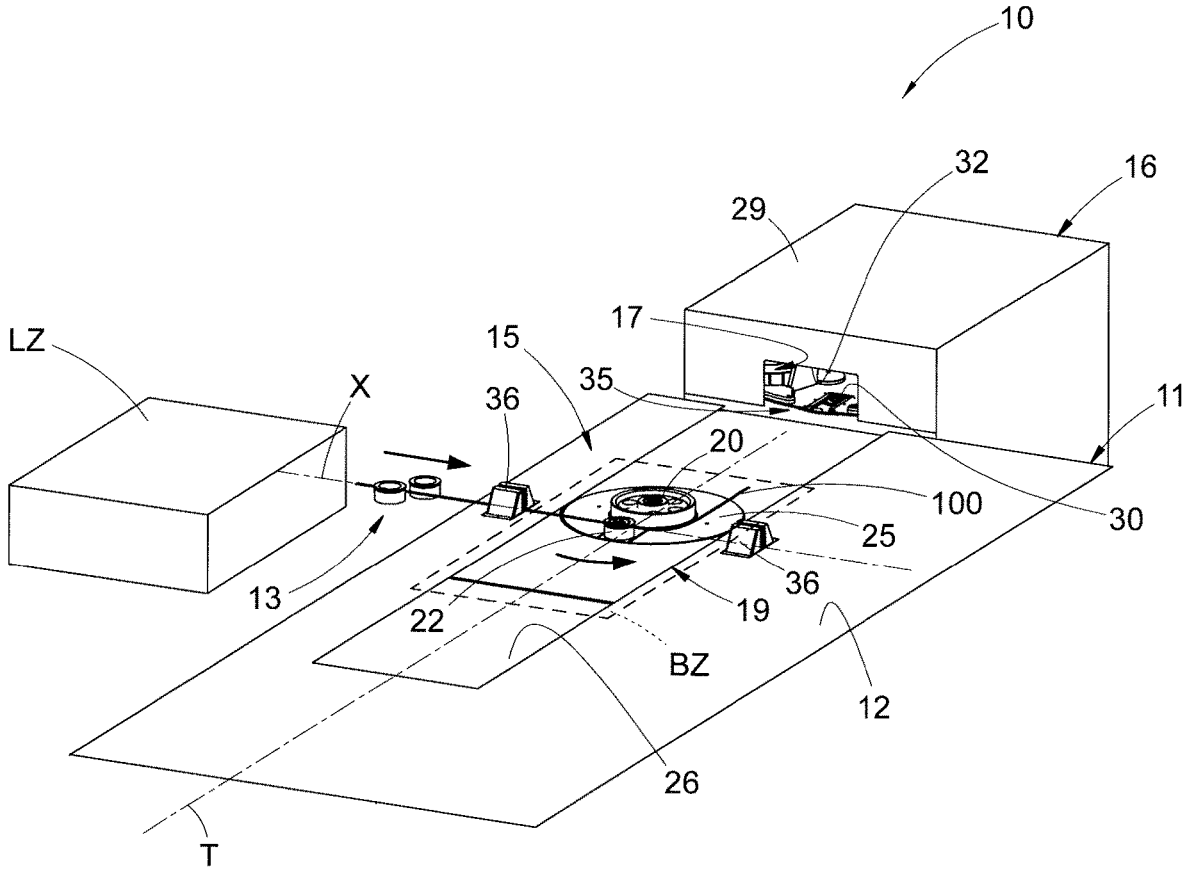
Figure 2:
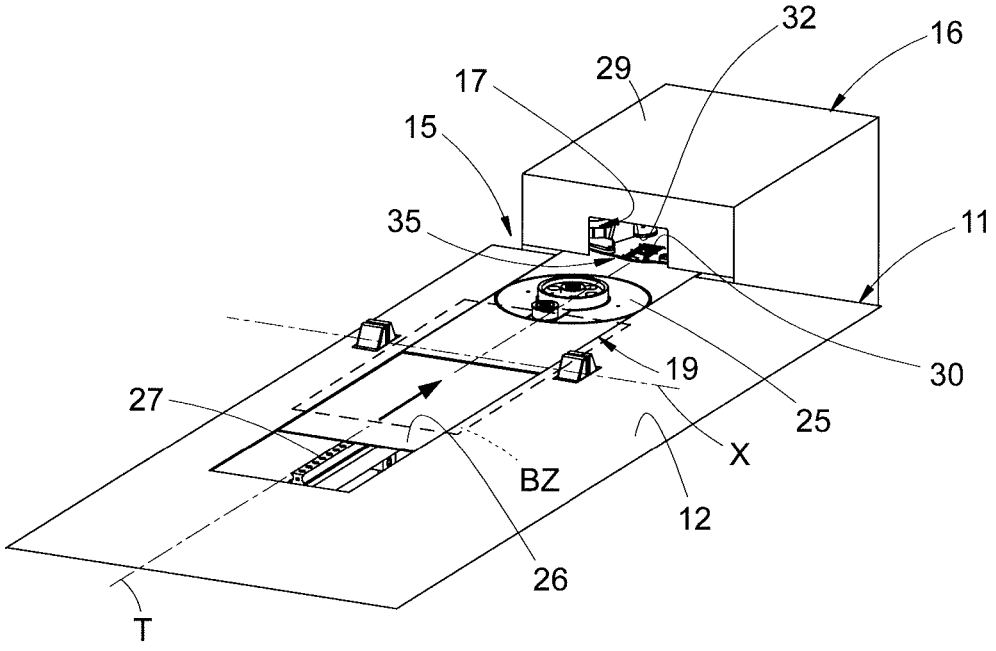

(51) Int. Cl.

| | |
|---|---|
| ***B21D 11/12*** | (2006.01) |
| ***B21D 11/22*** | (2006.01) |
| ***B21D 37/14*** | (2006.01) |
| ***B21F 1/00*** | (2006.01) |

(52) U.S. Cl.
CPC ..... *B21D 37/14* (2013.01); *B21D 37/147* (2013.01); *B21F 1/00* (2013.01)

(56) References Cited

U.S. PATENT DOCUMENTS

| | | | | | |
|---|---|---|---|---|---|
| 4,248,273 | A * | 2/1981 | Marcello | B21D 11/12 | 72/217 |
| 4,993,253 | A * | 2/1991 | Del Fabro | B21D 43/08 | 72/426 |
| 5,025,651 | A * | 6/1991 | Del Fabro | B21D 11/12 | 72/203 |
| 5,195,348 | A * | 3/1993 | Del Fabro | B21D 11/12 | 72/426 |
| 5,199,292 | A * | 4/1993 | Del Fabro | B21D 11/12 | 72/422 |
| 6,813,922 | B2 * | 11/2004 | Etienne | B21D 11/12 | 72/217 |
| 7,739,893 | B2 * | 6/2010 | Chien | B21D 11/12 | 72/217 |
| 9,566,636 | B2 * | 2/2017 | Del Fabro | B21D 11/12 | |
| 9,901,968 | B2 * | 2/2018 | Nozu | B21D 7/025 | |
| 2014/0000335 | A1 * | 1/2014 | Fries | B21F 1/00 | 72/362 |
| 2016/0175909 | A1 * | 6/2016 | Nozu | B21D 9/03 | 72/306 |

FOREIGN PATENT DOCUMENTS

| | | | | |
|---|---|---|---|---|
| JP | 2002143960 | A | 5/2002 | |
| WO | WO-2009135845 | A1 * | 11/2009 | B21D 7/022 |
| WO | 2023152776 | A1 | 8/2023 | |

* cited by examiner

APPARATUS AND METHOD FOR BENDING ELONGATED METAL PRODUCTS

CROSS-REFERENCE TO RELATED APPLICATIONS

This application is a U.S. National Stage Entry under 35 U.S.C. § 371 of International Patent Application No. PCT/IT2023/050031, entitled APPARATUS AND METHOD FOR BENDING ELONGATED METAL PRODUCTS, filed Feb. 7, 2023, which claims benefit of Italian Patent Application No. 102022000002417, filed Feb. 10, 2022, the entire disclosures of which are hereby incorporated by reference herein.

FIELD OF APPLICATION

The present invention relates to an apparatus and a related method for bending elongated metal products to obtain, preferably but not exclusively, brackets having a geometry suitable for the building applications for which they are intended. The elongated metal products can be bars, rods, or metal wires, which can be made available either as pre-cut segments or in continuous form wound on a reel and cut to the desired length before or at the end of the processing. In particular, the present invention is applied in apparatuses for making brackets which require bends with different radii.

STATE OF THE ART

Apparatuses for bending metal products are known, also called stirrup-making machines, configured to perform bends in sequence on a bar, a rod, a metal wire or other elongated metal product, so as to obtain brackets for example for making reinforcement cages. Such brackets can be two-dimensional, i.e., wherein the sides of the bracket lie on the same plane, or three-dimensional, i.e., wherein at least one side of the bracket lies on a different plane from that on which the other sides of the latter extend.

Generally, these apparatuses comprise one or more drawing units, one or more cutting units and at least one bending unit that performs the bends on a first bending plane, to define the two-dimensional shaping of the bracket, or possibly on further bending planes, angled with respect to the first bending plane, to define the three-dimensional shaping of the bracket.

The bending unit normally comprises a rotatable mandrel equipped centrally with a contrast pin and radially with a bending element.

The bending element is rotatable about the contrast pin so that the segment of metal product that is interposed between them is bent about the contrast pin.

It is also known that production requirements may require the production of brackets with different shaping, or made from bars of different dimensions, i.e. diameters, in the same batch of work, requiring the use of different bending units. Therefore, in these cases, there is a need for manual replacement and resetting of both the contrast pin and the bending pin.

Disadvantages of such known apparatuses are the prolonged production downtime, the use of specialized personnel and the use of auxiliary equipment for the transport and removal of the replacement bending units, with consequent increase in the time and costs of construction of the brackets.

In addition, at the end of the actual replacement operations, the apparatus must be calibrated for the execution of the new brackets with the required tolerances. These operations also involve a consequent increase in the time and costs of production, as well as a waste of metal material intended for the calibration tests of the apparatus itself.

Another disadvantage of such known apparatuses is that within the production site a specific magazine must be provided wherein the different bending units necessary to cover the production needs are stowed. This magazine, in addition to requiring a specific space, must guarantee determinate environmental storage conditions and requires a special management plan, with a consequent increase in costs and time necessary for the production of the brackets.

Solutions wherein the bending unit can be replaced automatically are also known, such as those disclosed in IT UD20 070 240 A1, JP 2002 143960 A, WO 2009/135845 A1 and US 2016/175909.

There is therefore a need to perfect an apparatus, and a corresponding method, for bending elongated metal products that can overcome at least one of the disadvantages of the state of the art.

It is therefore necessary to solve the technical problem of realizing, in an automated way, a series of bends on an elongated metal product using different bending units and minimizing the time and cost of replacing such bending units.

In particular, a purpose of the present invention is to provide an apparatus and a corresponding method for bending elongated metal products to obtain, substantially in the same production sequence, brackets having bends of different radii possibly also starting from metal products of different diameters, with high precision and quality.

Another purpose of the present invention is to provide an apparatus for bending elongated metal products that does not require specific spaces and management plans for a possible storage magazine for the different bending units necessary for the production activities.

Another purpose of the present invention is to realise an apparatus for bending elongated metal products that is simple in construction and operation, and enables the production of brackets with planar or three-dimensional conformation and a wide variety of shapes with reduced execution time.

A further purpose of the present invention is to provide an apparatus for bending elongated metal products which is fully automated.

The Applicant has devised, tested and embodied the present invention to overcome the shortcomings of the state of the art, and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes and to solve the aforesaid technical problem in a new and original manner, while also achieving considerable advantages with respect to the state of the art, an apparatus according to the present invention for bending elongated metal products comprises a feed device, configured to move said elongated metal products along a feed axis, and a first bending unit configured to execute one or more bends on one or more of said metal products at a time at a determinate bending zone.

According to one aspect of the present invention, the apparatus comprises both a storage area disposed distanced from said bending zone and configured to house, in a condition of inactivity, at least one distinct second bending unit, alternative to said first bending unit, and an exchanger device disposed in alternating cooperation with said first bending unit and with said second bending unit, and configured to selectively move said first bending unit, or said second bending unit, between said bending zone and said storage area along a direction of exchange.

Advantageously, the movement of the bending units between the bending zone and the storage zone takes place horizontally along said direction of exchange. The direction of exchange is preferably a transverse direction, in particular orthogonal, to the feed axis of the metal products.

In this way, by using the exchanger device, the first bending unit and the second bending unit can be positioned alternatingly or at the bending zone, to operate the desired bending of the elongated metal products, or at the storage area, to be maintained in a state of inactivity.

This replacement operation takes place with components included in the apparatus according to the present invention, i.e. in an automated way, therefore substantially without the manual intervention of specialized personnel, the use of external equipment or other operational complexities.

Therefore, with the solution according to the present invention it is possible to realize a series of bends on an elongated metal product by using different bending units in sequence and possibly alternating, thus being able to realize bends with different radii, and minimizing the time and costs of replacing such bending units.

With the apparatus according to the present invention it is therefore possible to obtain, substantially in the same production sequence, brackets made with metal products with different dimensions, or of different conformation, or with bends of different radii and angles, with high precision and quality.

According to another aspect of the present invention, the storage area comprises at least a first storage seating inside which the intended bending units are housed.

Also in accordance with the present invention, the storage area may also comprise at least one second storage seating, or a plurality of second storage seatings, inside each of which further corresponding bending units are housed, depending on the specific bending conditions envisaged for the project.

According to another aspect of the present invention, the exchanger device comprises at least one rotatable mandrel configured to alternately support, in a determinate operating condition, the first bending unit or the at least one second bending unit, wherein each of said bending units is provided with both its own central contrast pin and its own bending pin that is radially spaced and rotating with respect to the corresponding contrast pin.

According to another aspect of the present invention, the exchanger device is associated to a support plane of the apparatus and comprises a lifting actuator arranged in cooperation with the mandrel to determine a selective movement, substantially orthogonal to the support plane, both of the aforementioned contrast pins and simultaneously of the aforementioned bending pins.

According to another aspect of the present invention, the exchanger device comprises at least one movement member operatively connected to said mandrel and able to be moved in a direction of exchange to position the mandrel between the bending zone and the storage area.

According to another aspect of the present invention, in the storage area there is a movement mechanism connected to, or comprising, the aforementioned at least one storage seating, and configured to selectively move the at least one storage seating between a first position of cooperation in which it is disposed in correspondence with the mandrel and aligned with the direction of exchange, and a second storage position in which it is disposed away from the mandrel. The movement mechanism can be either rotary or linear.

The present invention also relates to a method for bending elongated metal products and comprises:

- a feeding step, wherein said feed device moves one or more of said elongated metal products at a time forward or backward along the feed axis; and
- a bending step, wherein the first bending unit performs one or more bends on the one or more metal products in correspondence with the bending zone.

According to one aspect of the present invention, the method comprises at least one replacement step, wherein the exchanger device places the aforementioned first bending unit, or the second distinct bending unit alternative to the first bending unit, in alternating cooperation with the bending zone and with the storage area disposed distanced from the bending zone and initially adapted to house, in a state of inactivity, at least the second bending unit.

ILLUSTRATION OF THE DRAWINGS

These and other aspects, characteristics and advantages of the present invention will become apparent from the following description of some embodiments, given as a non-restrictive example with reference to the attached drawings wherein:

FIG. 1 is a schematic plan view of an apparatus for bending elongated metal products, according to the present invention;

FIGS. 2-11 schematically show a possible operating sequence of the method for bending elongated metal products, according to the present invention.

We must clarify that in the present description the phraseology and terminology used, as well as the figures in the attached drawings also as described, have the sole function of better illustrating and explaining the present invention, their function being to provide a non-limiting example of the invention itself, since the scope of protection is defined by the claims.

To facilitate comprehension, the same reference numbers have been used, where possible, to identify identical common elements in the drawings. It is understood that elements and characteristics of one embodiment can be conveniently combined or incorporated into other embodiments without further clarifications.

DISCLOSURE OF SOME EMBODIMENTS OF THE PRESENT INVENTION

With reference to FIG. 1, an apparatus 10 according to the present invention is configured to bend an elongated metal product, or more than one at a time, in this case one or more metal bars 100, so as to make brackets or other reinforcement shapes for construction having a determinate geometry. The bars 100 can have a length between approximately 1.5 m and approximately 24 m, however not less than approximately 0.5 m, and diameters between approximately 10 mm and approximately 40 mm.

The apparatus 10 comprises a fixed structure 11 having a support plane 12, disposed substantially horizontally with respect to an installation surface of the apparatus 10. However, it is not excluded that the support plane 12 may also be inclined with respect to this installation surface, for example to facilitate the removal under gravity of the brackets made.

The support plane 12 can comprise or be formed by a metal sheet or plate having a determinate thickness and a substantially rectangular shape. The support plane 12, in turn, comprises a bending zone BZ, shown schematically in a dashed line in the attached figures, where the bending of the bar 100 is actually executed.

It is clear that the size and shape of the support plane 12 is consistent with the maximum length of the bars 100 to be processed.

The apparatus 10 comprises a loading zone LZ, arranged upstream of the support plane 12, and wherein the bars 100 are contained in the form of pre-cut segments or wound in continuous form on a reel and cut to the desired length.

The apparatus 10 also comprises a feed device 13 arranged between the loading zone LZ and the support plane 12, substantially of the known type and only schematically shown in FIG. 1, which is configured to feed the bars 100 at least from the loading zone LZ towards the bending zone BZ along a feed axis X.

As disclosed in FIGS. 1-11 by way of example, the feed device 13 may be fixed and comprise a series of drawing rollers. According to further embodiments not shown, the feed device 13 can comprise a gripper suspended above the support plane 12 movable along its own axis of movement. In the latter case, the feed device 13 can also be configured to manipulate the bars 100 during the bending operations and to move them, possibly, even beyond the bending zone BZ in the direction opposite to the feeding zone LZ.

The apparatus 10 further comprises, downstream of the support plane 12, a discharge zone, of a substantially known type and not shown in the attached figures, where a plane or a trolleyed container configured to receive the shaped bars 100, i.e. the brackets, can be present.

The apparatus 10 comprises, in addition to the feed device 13, a first bending unit 15 configured to bend the bars 100 according to a first bending configuration, i.e. with a first bending radius, and a storage area, or magazine, 16 inside of which at least a second bending unit 17 is arranged which, as will be explained in detail below, is operationally alternative to the first bending unit 15 for bending the bars 100 according to a second bending configuration, i.e. with a second bending radius. In other words, when the first bending unit 15 is in an operating condition for performing bends on the bar 100, the second operating unit 17 is arranged inside the magazine 16 in a condition of non-use or inactivity.

The apparatus 10 also comprises an exchanger device 19, in this case, arranged in cooperation with the support plane 12. This exchanger device 19 is configured to move the two bending units 15, 17, in alternation with each other, between the bending zone BZ, wherein the bending unit 15, 17, which is in the operating condition, can perform the bending of the bars 100, and the magazine 16, wherein the other of the bending units 17, 15, which is in the non-use condition, is stopped waiting to be collected.

The magazine 16 is external to the bulk of the support plane 12.

The magazine 16 is arranged in a fixed position, for example with respect to the support plane 12, laterally with respect to the bending zone BZ.

In particular, each bending unit 15, 17 is respectively provided with a central contrast pin 20, 21 and a bending pin 22, 23, radially spaced and rotating with respect to the corresponding contrast pin 20, 21, to define the desired bending on the bar 100.

The contrast pins 20, 21 have a substantially cylindrical shape. It is not excluded that in different operating solutions contrast pins 20, 21 can be provided double, shaped or of other shapes and sizes.

Each bending pin 22, 23 is selectively rotatable clockwise, or counter-clockwise, around the corresponding contrast pin 20, 21 so as to make the desired bend on the bar 100, in one direction or the other, in cooperation with the respective contrast pin 20, 21.

In this case, the contrast pins 20, 21 and the bending pins 22, 23 define two different types of bending units 15, 17, for example, shaped to bend bars 100 of different diameters, or to make brackets with different configurations, or bending radii, such that different pins must be used.

For the sake of descriptive brevity, the apparatus 10 and the method applicable to the replacement of two different types of bending units 15, 17 are disclosed, but it is not excluded that operative variants can be realized wherein one or more further different bending units are provided, applicable, in turn, to the bending of specific bars 100, or feasible for the realization of further bracket conformations.

The exchanger device 19 comprises at least one rotatable mandrel 25, which is common for both bending units 15, 17, i.e. it is shaped to cooperate alternately with both contrast pins 20, 21 and with both bending pins 22, 23, so as to implement the bending action thereof, when they are in the bending zone BZ.

Furthermore, the exchanger device 19 comprises both a movement member, in this case a movement carriage, 26 above which the mandrel 25 is rotatably mounted and a corresponding guide rail 27 on which the movement carriage 26 is slidably mounted to be selectively moved between an operating position, wherein the mandrel 25 is positioned in the bending zone BZ, and an exchange position, wherein the mandrel 25 is positioned in cooperation with the magazine 16.

The movement of the movement carriage 26 between the operating position and the exchange position takes place along a direction of exchange T. As shown in FIGS. 1-11, the direction of exchange T is transverse with respect to the feed axis X. However, solutions wherein the direction of exchange T is parallel to the feed axis X are not excluded. This depends, in essence, on the position of the magazine 16.

The carriage 26 is movable between the operating position and the exchange position on a movement plane parallel to the support plane 12.

The implementation of such selective movement of the movement carriage 26 with respect to the guide rail 27, takes place by means of a linear positioner. Such a linear positioner may be, or comprise, an electric or hydraulic motor, serviced by position transducers, a hydraulic or pneumatic cylinder, in a substantially known manner and not illustrated in the accompanying figures.

Figure 6:
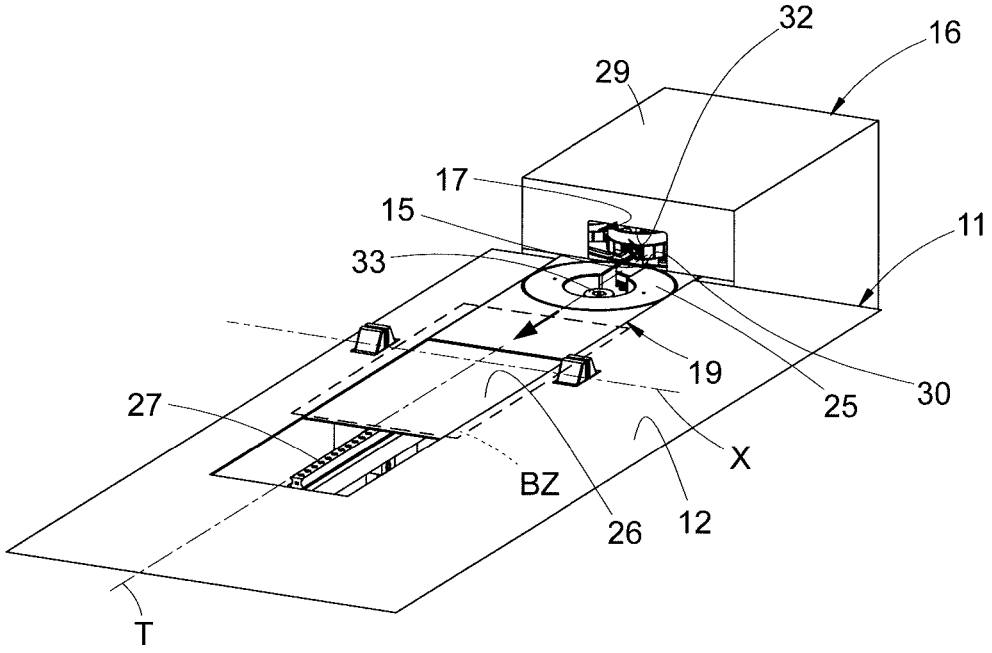
Figure 7:
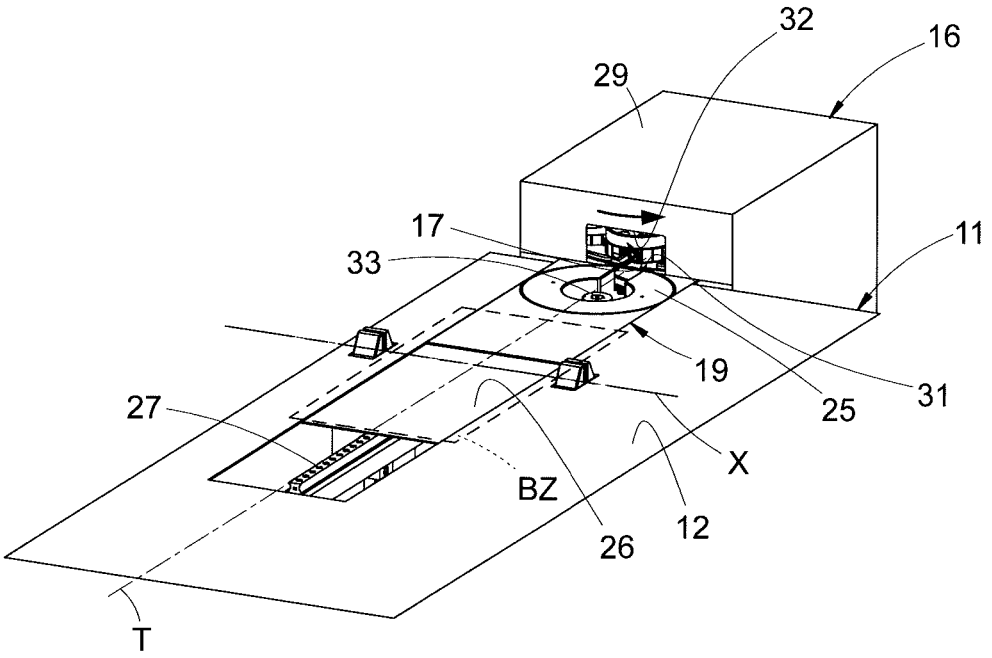

The exchanger device 19 further comprises a lifting actuator 33, only partially illustrated in FIGS. 6 and 7, arranged in cooperation with the mandrel 25, for determining the selective movement substantially orthogonal to the support plane 12, of the contrast pins 20, 21 and of the bending pins 22, 23.

The magazine 16 comprises a containment structure 29, arranged adjacent to the support plane 12, disposed distanced from the bending zone BZ, and configured to contain therein at least two storage seats 30, 31, shaped to house the respective bending units 15, 17, in a non-use condition inside the containment structure 29.

Each storage seating 30, 31 is substantially aligned at the same height as the movement plane of the carriage 26.

The containment structure 29 further comprises an opening 32, facing the bending zone BZ, and through which each bending unit 15, 17 can be moved to access, or separate itself from, the corresponding storage seating 30, 31.

Furthermore, each storage seating 30, 31 is selectively positionable in correspondence with the opening 32, by means of a movement mechanism 35 with which they are associated. The movement mechanism 35 is, in this case, of the rotary type, for example with a carousel.

The apparatus 10 also comprises two retaining devices 36, which are arranged aligned with the feed axis X and on opposite sides with respect to the bending zone BZ, and are configured to temporarily retain the bars 100 during the execution of the bending to avoid unwanted bending and deformation. The selective activation of one or the other retaining device 36 depends on the end of the bar 100 where the bending is intended to be performed, in a manner known per se and not disclosed here.

The operation of the apparatus 10 as described heretofore, which corresponds to the method according to the present invention, comprises the following steps:

- a feeding step, wherein the feed device 13 moves one or more bars 100 at a time forward or backward along the feed axis X,
- a bending step, wherein the first bending unit 15 performs one or more bends through the combined action of the central pin 20 and the bending pin 21 in correspondence with the bending zone BZ with the first bending radius.

The method further comprises at least one replacement step, wherein the exchanger device 19 moves the first bending unit 15, to bring it into cooperation with the corresponding storage seating 30, and picks up the second bending unit 17 from the corresponding storage seating 31, to bring it into operating condition in the bending zone BZ.

In more detail according to the embodiment illustrated in FIGS. 2 to 11, this step is carried out operationally as follows.

When there is a need to replace the first bending unit 15 with the second bending unit 17, for example to perform a further bending on the bar 100 with the second bending radius, the bending step comprises a first sub-step (FIG. 2) wherein the movement of the mandrel 25 outside the bending zone BZ, in the direction of the magazine 16, is provided by movement of the carriage 26 on the rail 27 along the transverse direction T.

Figure 3:
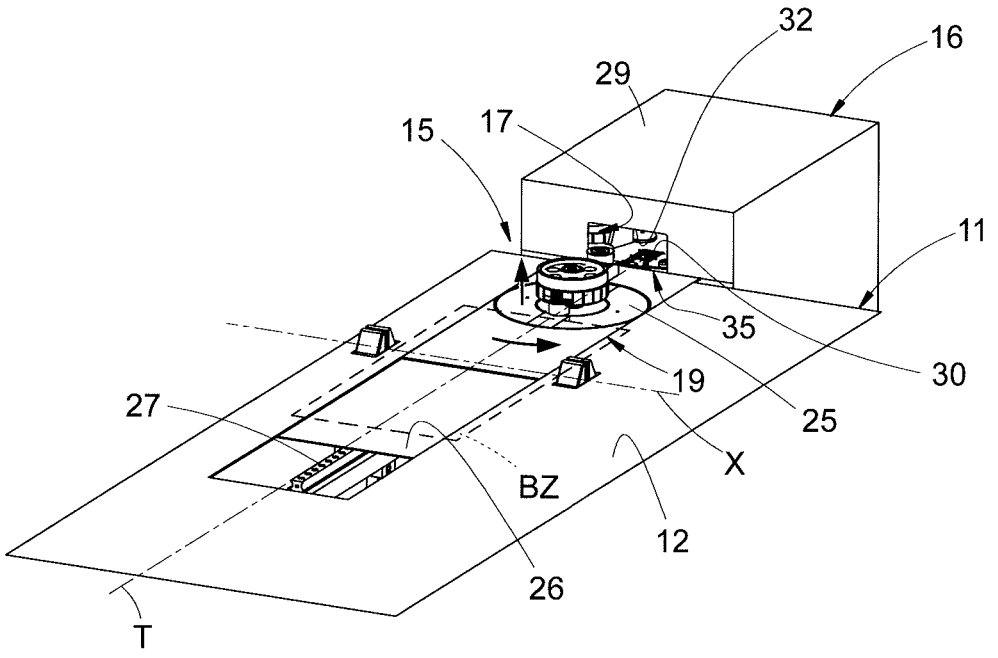

Subsequently, as shown in FIG. 3, in a second sub-step the mandrel 25 rotates the bending pin 22, in this case by 180°, while the actuator 33 lifts both the contrast pin 20 and the bending pin 22 by a desired amount with respect to the support plane 12, to prepare the bending unit 15 for insertion into the magazine 16.

Figure 4:
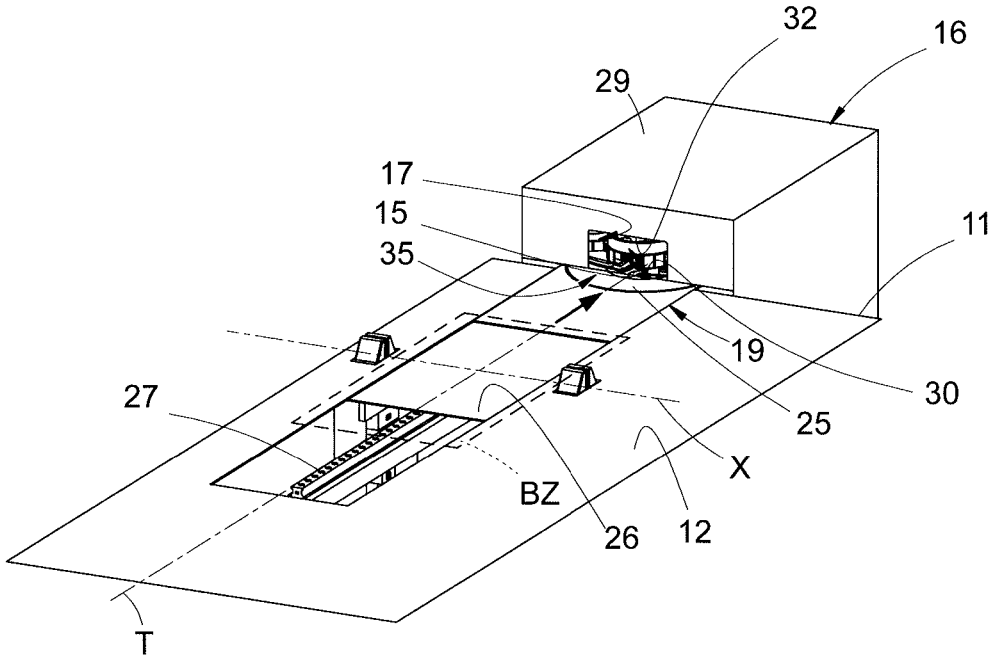

In fact, as shown in FIG. 4, the carriage 26 continues its movement towards the magazine 16, bringing the bending unit 15 inside the containment structure 29, through the opening 32.

In this way, the bending unit 15 is brought into a pre-positioning condition at the corresponding storage seating 30.

Figure 5:
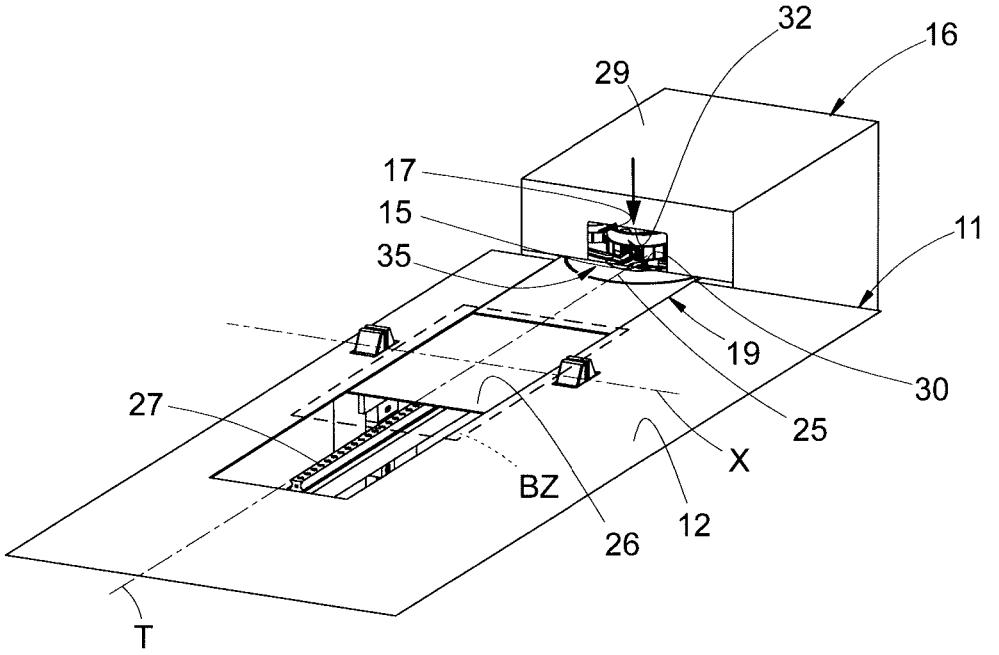

In a third sub-step illustrated in FIG. 5, the actuator 33 lowers the bending unit 15, until it is brought into a condition of stable cooperation with the corresponding storage seating 30.

At this point, as illustrated in FIG. 6, in a fourth sub-step the carriage 26 moves the mandrel 25 bringing it outside the magazine 16, so as to allow the movement mechanism 35 to rotate the storage seatings 30 and 31, inside the containment structure 29, so as to carry the storage seating 31 and the corresponding bending unit 17, at the opening 32 (FIG. 7).

In this condition the bending unit 15 is in a rest or storage condition inside the containment structure 29.

Figure 8:
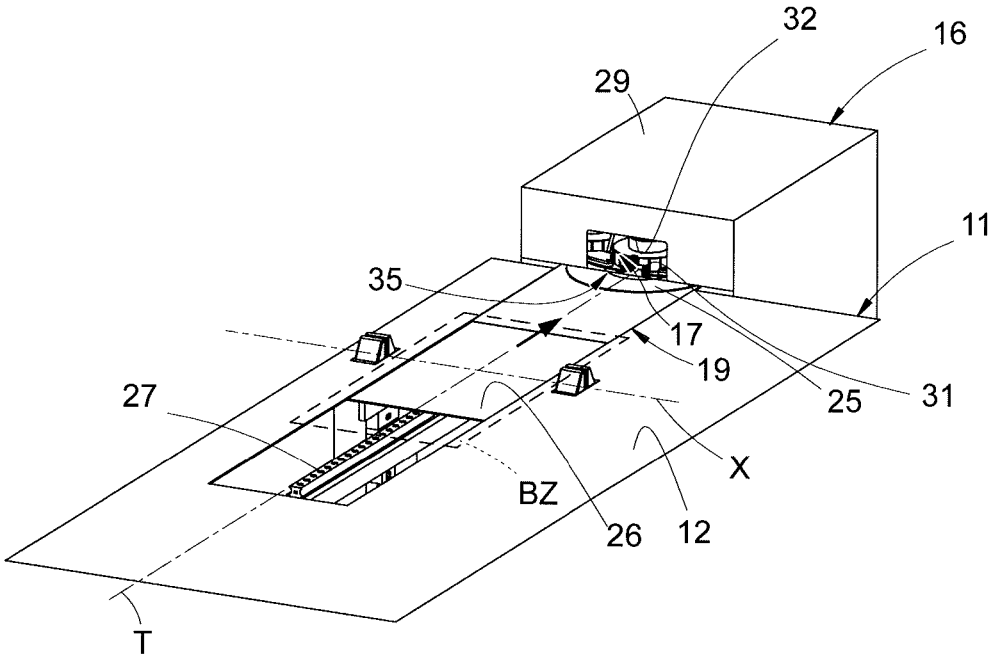

Once this condition of positioning of the two bending units 15 and 17 has been reached, in a fifth sub-step the carriage 26 moves the mandrel 25 back inside the magazine 16, positioning it below the bending unit 17 to be picked up (FIG. 8).

Figure 9:
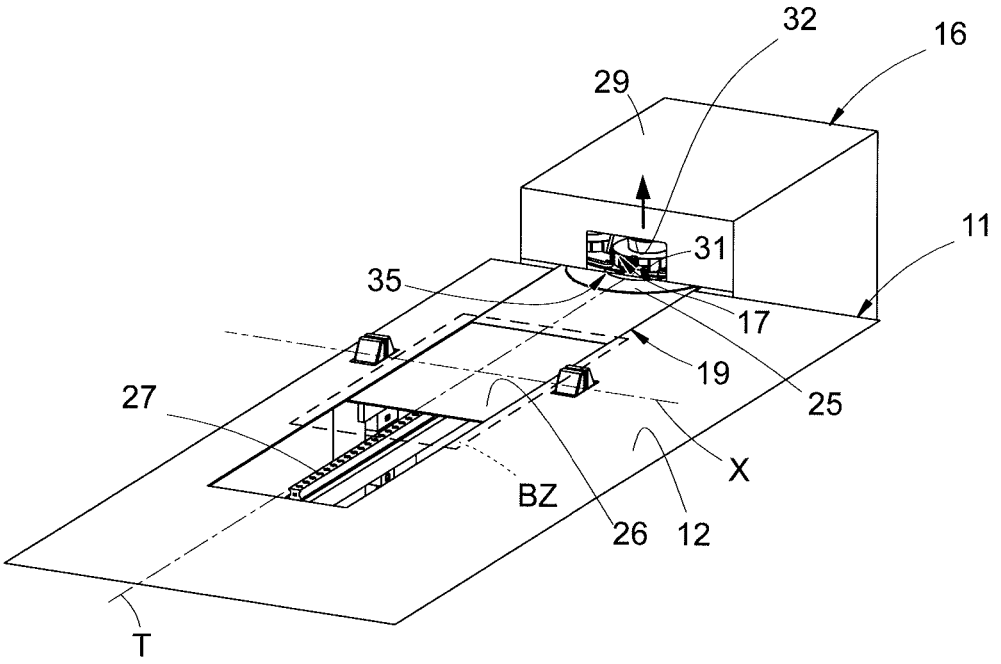

FIG. 9 shows a schematic illustration of the way in which, through the action of the actuator 33, the second bending unit 17 is released from the corresponding storage seating 31, and arranged to be picked up from the magazine 16.

Figure 10:
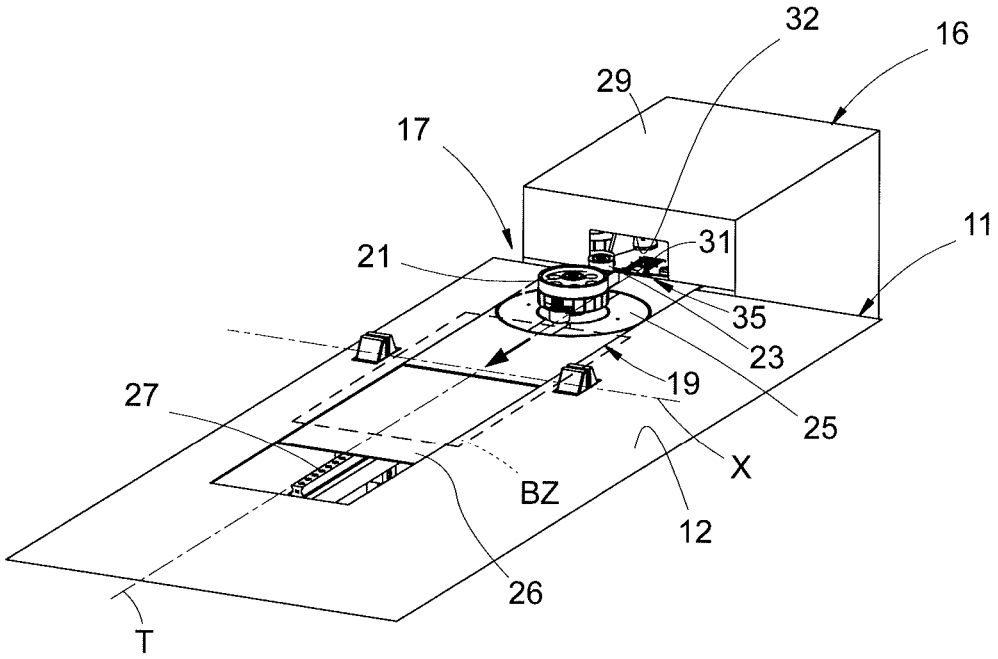

In fact, as shown in FIG. 10, the movement carriage 26 is moved in the direction of the bending zone BZ, so that the bending unit 17 is completely extracted from the containment structure 29, through the opening 32.

At this point, inversely to the procedure shown in FIG. 3 for the bending unit 17, the actuator 33 lowers the contrast pin 21 and the bending pin 23 in a condition of cooperation with the support plane 12, while the mandrel 25 performs a rotation of the bending pin 23, in this case by 180°.

Figure 11:
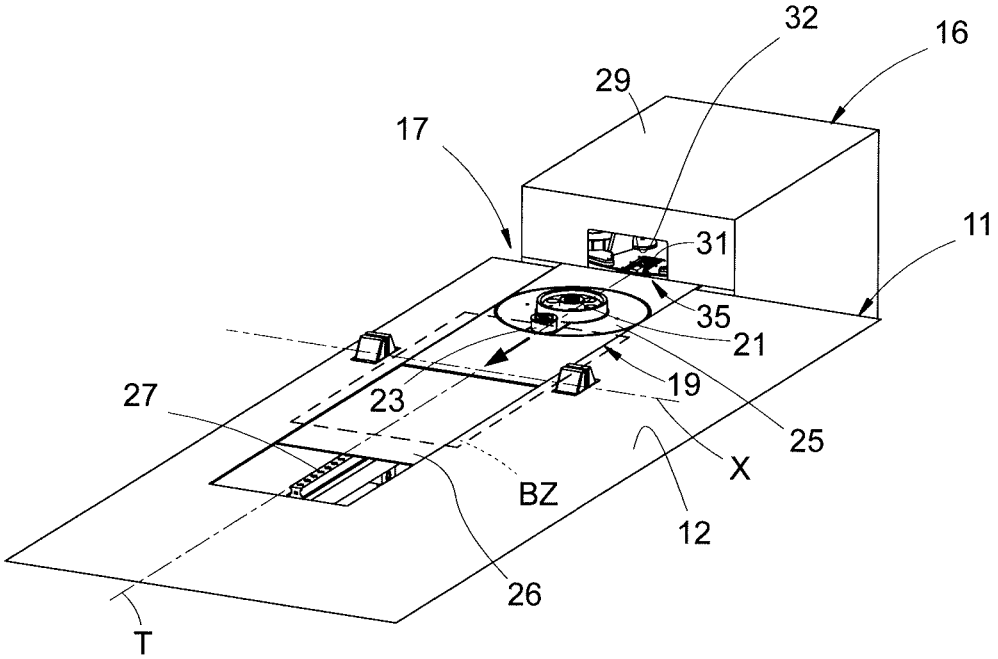

Finally, as shown in FIG. 11, in a sixth sub-step the bending unit 17 is positioned by the carriage 26, in the bending zone BZ, to start the bending of bars 100, according to its specifications and desired bending characteristics, or sequences.

It is clear that modifications and/or additions of parts may be made to the apparatus 10 and to the method as described heretofore, without departing from the field and scope of the present invention, as defined by the claims.

For example, according to the variant wherein one or more other bending units are provided, the rotation of the storage seating inside the containment structure 29, by the action of the movement mechanism 35, is always functional to the positioning of the selected bending unit in correspondence with the opening 32.

According to another variant, the storage seatings 30, 31 are arranged in line with each other, and the movement mechanism 35 is consequently shaped to implement a selective linear movement.

It is also clear that, although the present invention has been described with reference to some specific examples, a person skilled in the art will be able to make many other equivalent forms of an apparatus and method for bending elongated metal products having the characteristics as set forth in the claims and hence all coming within the field of protection defined thereby.

In the following claims, the sole purpose of the references in brackets is to facilitate their reading and they must not be considered as restrictive factors with regard to the field of protection defined by the same claims.

The invention claimed is:

1. An apparatus (10) for bending elongated metal products (100) comprising a feed device (13), configured to move said metal products (100) along a feed axis (X), a first bending unit (15), configured to perform one or more bends on one or more of said metal products (100) at a time in correspondence with a determinate bending zone (BZ), and a storage area (16) disposed distanced from said bending zone (BZ) and configured to house, in a condition of inactivity, at least one distinct second bending unit (17), alternative to said first bending unit (15), wherein each of said bending units (15, 17) is provided with a central contrast pin (20, 21) of its own, and with a bending pin (22, 23) of its own which is radially distanced from and rotating with respect to the corresponding contrast pin (20, 21), wherein the apparatus further comprises an exchanger device (19) comprising at least one rotatable mandrel (25) configured to alternately support, in a determinate condition, said first bending unit (15) or said at least one distinct second bending unit (17), said exchanger device (19) being configured to move said first bending unit (15) or said at least one distinct second bending unit (17) horizontally along a direction of exchange (T) between said bending zone (BZ) and said storage area (16), wherein said storage area (16) is disposed in a fixed position laterally to said bending zone (BZ).

2. The apparatus (10) of claim 1, wherein said storage area (16) comprises at least one storage seating (30, 31) inside which said at least one distinct second bending unit (17), or said first bending unit (15), are able to be alternately housed.

3. The apparatus (10) of claim 2, further comprising at least one other bending unit alternative both to said first bending unit (15) and also to said at least one distinct second bending unit (17), wherein said storage area (16) comprises at least one other storage seating inside which said at least one other bending unit (15), said at least one distinct second bending unit (17), or said first bending unit (15), are able to be alternately housed.

4. The apparatus (10) of claim 2, wherein said storage area (16) comprises a movement mechanism (35) connected to, or comprising, said at least one storage seating (30, 31), and configured to selectively move said at least one storage seating (30, 31) between a first position of cooperation in which it is disposed in correspondence with said at least one rotatable mandrel (25) and aligned with said direction of exchange (T), and a second storage position in which it is disposed away from said at least one rotatable mandrel (25).

5. The apparatus (10) of claim 4, wherein said movement mechanism (35) is of a rotary type.

6. The apparatus (10) of claim 4, wherein said movement mechanism (35) is of a linear type.

7. The apparatus (10) of claim 1, wherein said exchanger device (19) is associated with a support plane (12) and comprises a lifting actuator (33) disposed in cooperation with said at least one rotatable mandrel (25) to determine a selective movement, substantially orthogonal to said support plane (12), of said contrasting pins (20, 21) and of said bending pins (22, 23).

8. The apparatus (10) of claim 1, wherein said exchanger device (19) comprises at least one movement member (26) operatively connected to said at least one rotatable mandrel (25) and able to be moved in said direction of exchange (T) in order to position said at least one rotatable mandrel (25) between said bending zone (BZ) and said storage area (16).

9. A method for bending elongated metal products (100) the method comprising: a feeding step, wherein a feed device (13) moves one or more of said metal products (100) at a time along a feed axis (X) forward or backward, a bending step, wherein a first bending unit (15) performs one or more bends on one or more metal products (100) in correspondence with a determinate bending zone (BZ), and at least one replacement step, wherein at least one distinct second bending unit (17), alternative to said first bending unit (15), and housed, in a condition of inactivity, in a storage area (16) disposed distanced from said bending zone (BZ), is replaced to said first bending unit (15) for performing one or more further bends on one or more metal products (100) in correspondence with said bending zone (BZ), wherein in said replacement step an exchanger device (19), having at least one rotatable mandrel (25) configured to alternately support, in a determinate condition, said first bending unit (15) or said at least one distinct second bending unit (17), places, by moving it horizontally along a direction of exchange (T), said first bending unit (15), or said at least one distinct second distinct bending unit (17), in alternating cooperation with said bending zone (BZ) and with said storage area (16), wherein said storage area (16) is disposed in a fixed position laterally to said bending zone (BZ).

* * * * *